United States Patent [19]

Dölz

[11] Patent Number: 4,474,537

[45] Date of Patent: Oct. 2, 1984

[54] OSCILLATING COMPRESSOR

[76] Inventor: Heinrich Dölz, Berliner Strasse 66, D 6368 Bad Vilbel, Fed. Rep. of Germany

[21] Appl. No.: 574,170

[22] Filed: Jan. 26, 1984

Related U.S. Application Data

[63] Continuation of Ser. No. 271,863, Jun. 9, 1981, abandoned.

[30] Foreign Application Priority Data

Jun. 11, 1980 [DE] Fed. Rep. of Germany ..... 3021873

[51] Int. Cl.[3] ..... F04B 17/04; H02K 33/14

[52] U.S. Cl. ..... 417/44; 62/229; 310/35; 318/130; 417/417

[58] Field of Search ..... 417/44, 417; 310/34, 310/35; 200/82 R; 318/127–130; 62/228, 229

[56] References Cited

U.S. PATENT DOCUMENTS

| | | | |
|---|---|---|---|
| 2,721,024 | 10/1955 | Zeh . | |
| 2,951,131 | 8/1960 | Lancier | 200/82 R X |
| 3,779,544 | 12/1973 | Wasielewski | 318/127 |
| 3,840,789 | 10/1974 | Dion | 318/130 |
| 4,027,211 | 5/1977 | Omura et al. | 417/417 |
| 4,086,518 | 4/1978 | Wilkinson | 318/127 |
| 4,122,378 | 10/1978 | Brown | 318/128 |

FOREIGN PATENT DOCUMENTS

| | | |
|---|---|---|
| 1096475 | 1/1961 | Fed. Rep. of Germany . |
| 1453442 | 5/1972 | Fed. Rep. of Germany . |
| 1488543 | 12/1973 | Fed. Rep. of Germany . |
| 2558667 | 6/1978 | Fed. Rep. of Germany . |
| 1497161 | 10/1966 | France . |

*Primary Examiner*—William E. Wayner

*Attorney, Agent, or Firm*—William D. Hall; Darle M. Short

[57] ABSTRACT

The invention relates to an electrically driven oscillating compressor, in particular for use as refrigerating machine, comprising a piston compressor, an electric oscillating drive for directly driving the piston compressor and a pulse shaper for supplying energy to the electric oscillating drive, wherein the group consisting of the compressor piston which is resiliently held in a central initial position, the other oscillating masses, the gas spring rate and the electric components of the oscillating drive form an electro-mechanical oscillating system whose natural frequency is at least approximately equal to the frequency of the current energizing the oscillating drive. In order to achieve an increased output—as related to the physical dimensions of the unit—and also improved efficiency and, on the other hand, the highest possible degree of independence from possible voltage and frequency variations of the supply voltage, the working pressures and other parameters, the upper dead center position of the compressor piston can be set to a predetermined value in the area of the pressure-side cylinder end, by controlling the energy content of the current pulses supplied by the pulse shaper.

7 Claims, 7 Drawing Figures

OSCILLATING COMPRESSOR

This is a continuation of application Ser. No. 271,863, filed June 9, 1981, now abandoned.

The present invention relates to an electrically driven oscillating compressor, in particular for use as refrigerating machine, comprising a piston compressor, an electric oscillating drive for directly driving the piston compressor and a pulse shaper for supplying energy to the electric oscillating drive, wherein the group consisting of the compressor piston which is resiliently held in a central initial position, the other oscillating masses, the gas spring rate and the electric components of the oscillating drive form an electro-mechanical oscillating system whose natural frequency is at least approximately equal to the frequency of the current energizing the oscillating drive.

Depending on the operating mode and design of the electric oscillating drive, the pulse shaper supplies current pulses of alternating polarity (alternating-current operation) or pulses of uniform polarity (pulse operation, half-wave operation).

There have been known certain types of oscillating compressors of the technical concept described above in which in an effort to increase the efficiency the freqeuncy of the supply current for the oscillating drive is synchronized via a pulse shaper with the electromechanical natural frequency of the oscillating compressor, and also others which use only one or more oscillating springs. In addition, there have been known oscillating compressors which have their compressor piston fixed to the housing while the cylinder performs the reciprocating movements, or others in which the compressor piston and the cylinder move in opposite senses.

In practice, the oscillating compressors used most are those which have a permanent-dynamic oscillating drive consisting of a driving coil taking the form of a cylindrical oscillating coil rigidly connected to the compressor piston and arranged to move without any contact within an annular gap comprising a radial DC magnetic field produced by a permanent magnet. This DC magnetic field passes vertically through the turns of the oscillating coil and extends also vertically to the direction of movement of the oscillating coil and compressor piston assembly. Thus, the oscillating coil which is passed by current pulses of alternating polarity is subjected to current forces acting in the two directions of movement of the compressor piston and oscillating coil assembly.

Inspite of its simple constructional design (only one moving part, often only one single lubricating point), oscillating compressors have found only limited application. For, the known oscillating compressors have been connected with the fundamental disadvantage that the stroke of the compressor piston depends largely on the compressor output, the operating pressures, the supply voltage which in the case of battery operation may vary within broad limits, the winding temperature and still other factors. Experience has shown, that as a result thereof the piston stroke may easily vary by 50%.

If the upper dead center position, i.e. the pressure-side stationary point of the piston, is selected to ensure that even when performing the maximum possible stroke the piston will be kept just clear of the cylinder end and, thus, the cylinder bottom, it results as a disadvantage that in many other operating conditions the compressor output and in particular the compression ratio will be too low because of the excessively big clearance volume at the pressure side of the piston. In order to improve the output of the oscillating compressor, the pressure valve has been given the form of a pressure valve plate covering the whole cylinder cross-section and pressed by spring force against the pressure-side cylinder rim acting as valve seat. In this manner, it was possible to displace the upper dead center position for the maximum stroke beyond the cylinder end, whereby an acceptable compressor output was achieved under most operating conditions. However, it is a disadvantage of this arrangement that even if fully enclosed the oscillating compressor produces a disturbing noise and that its physical dimensions must be selected to ensure that even maximum over-strokes will not result in mechanical damage. On the other hand, however, it must be ensured that with minimum stroke the compressor output will not unduly drop and that with great stroke the winding temperature of the oscillating coils will not be exceeded. Further, the oscillating springs must be dimensioned for continuous over-stroke operation. In the case of portable units energized from a battery it is of particular disadvantage that the relatively small rise of the compressor output derived from over-stroke operation is absolutely out of proportion to the increased power consumption; the efficiency is clearly reduced.

Now, it is the object of the present invention to provide an improved oscillating compressor which is smaller in size than the oscillating compressors of the same output known heretofore or offers an increased output and improved efficiency than the oscillating compressors of the same size known heretofore. Further, it is also an object of the invention to provide a compressor whose efficiency is largely independent of any voltage and frequency variations of the supply voltage.

According to the invention, this object is achieved in an electrically driven oscillating compressor of the type described before by an arrangement in which the upper dead center position of the compressor piston can be set to a pre-determined value in the area of the pressure-side cylinder end, by controlling the energy content of the current pulses supplied by the pulse shaper.

From this arrangement, surprising advantages can be derived. On the one hand, the upper dead center, i.e. the pressure-side stationary point of the oscillating compressor is fixed, but can be adjusted or varied if need arises, while on the other hand the lower dead center or suction-side stationary point remains variable. Considering that it is no longer necessary to adapt the mechanical, dimensional and electric design of the oscillating compressor to possible over-strokes, the size of the compressor can be reduced for the same output, or else an increased output can be achieved with the same dimensional size. Also, the object to make the compressor indpendent of the frequency and voltage variations of the supply voltage has been achieved. Of course, it cannot be ensured that the pre-determined upper dead center position will be observed at any operating pressures or even extremely low supply voltages outside the operating range for which the respective oscillating compressor has been designed. In any case, however, it is ensured that no over-stroke of the compressor piston will be encountered, not even under operating conditions outside the operating range.

Thus, by fixing the upper dead center position, the clearance volume can be kept as small in an oscillating compressor as in a motor compressor in which the piston is driven by an electric motor via a crank assembly.

In the case of oscillating compressors comprising a spring-loaded pressure valve plate extending over the whole cylinder cross-section and resembling in its function a liftable cylinder bottom, the invention makes it possible to reduce the clearance volume even to a size smaller than that encountered in motor compressors. To this end, the upper dead center is displaced into the over-stroke region of the compressor piston so that the compressor piston must perform a very small over-stroke. This has a very advantageous effect at high pressure ratios of the gases to be delivered.

An essential advantage of the oscillating compressor of the invention over motor compressors is to be seen in the variable piston stroke, the stroke being not physically limited in the direction of suction. The central position of the piston is displaced during operation depending on the pressure differences encountered in operation between the delivery pressure and the suction pressure of the gas to be delivered, and as a result thereof the piston stroke increases as the pressure difference rises. This proves particularly advantageous when the compressor of the invention is used in refrigeration equipment, because here increased room temperatures, i.e. increased pressure differences in the refrigeration gases to be delivered, increase the need for sufficient compressor output and, thus, sufficient refrigeration capacity. While the geometrical working volume of the motor compressor remains absolutely constant, the working volume of the oscillating compressor rises in a very desirable manner as the pressure differences increase, and this meets the practical requirements in a very efficient manner. So, the piston stroke adapts itself to the pressures prevailing from time to time.

Another advantage of the invention is to be seen in the fact that the refrigerating capacity of a refrigeration unit equipped with a compressor according to the invention remains constant, regardless of the supply voltage. Even variations in the supply voltage by ±25% in the case of operation from a motor-car battery are balanced.

In the case of oscillating compressors operating in resonance with their electro-mechanical natural frequency and energized from a motor-car battery, extreme over-strokes of the compressor piston could be encountered in the event of high supply voltages and low compressor capacities (low outside temperature and low evaporation temperature). These over-strokes were very difficult to control by constructional measures and are eliminated by the design of the invention.

A final advantage of the compressor of the invention over motor compressors is to be seen in the fact that it will safely start even under considerable undervoltage conditions and that, when equipped with a permanent-dynamic oscillating drive, it will reach a power factor (cos phi) of over 0.9 and high efficiency. As compared to this, motor compressors used in household refrigerators, for instance, have a cos phi of only 0.55 to 0.6.

The determination of the upper dead center position can be effected in many different ways. In preferred embodiments of the invention, an end sensing element is provided for this purpose in the oscillating compressor which coacts with a signal converter to emit an electric signal as soon as the compressor piston has reached or exceeded the predetermined upper dead center position. The end sensor element may take the form of an electric contact (normally-open or normally-closed contact) or an inductive,capacitive or optical sensor or even the form of a magnetic field depending resistor. Preferably, however, an electric contact (normally-open or normally-closed contact) is used as end sensing element, if need be in connection with a high-resistance signal converter connected to its output.

This eliminates any burning of the contact, even in long years of operation. Preferably, the end sensing element takes the form of a helical spring coacting with another fixed contact, the helical spring having one end projecting into the path of an element fastened to the compressor piston to move therewith. Such a mechanical end sensing element can be produced in a simple manner, at low cost and with great reliability. Its wear can be easily kept below the degree of wear of other wearing parts of the oscillating compressor so that a practically unlimited service life can be expected.

The upper dead center position can be determined by the selection of the appropriate position of the end sensing element. And even later, the upper dead center position can be adjusted by slightly rebending the fixed coacting contact.

The upper dead center position can be freely selected in line with the principles outlined above. To achieve the maximum possible output, it should come to lie at the beginning of the over-stroke area (the piston moves a little beyond the cylinder end and comes into contact with the valve plate). Particularly preferred embodiments, however, have the upper dead center positioned shortly before the cylinder end. This arrangement offers the advantage of a particularly low noise level of the oscillating compressor, because the piston does not get into contact with the plate valve.

The upper dead center position as fixed by the end sensing element is observed by the compressor piston when its upper dead center position can be made to coincide with the reaction point of the end sensing element. This cannot be achieved by a conventional two-step action control. During understroke operation (the piston in its upper dead center position does not reach the operating point of the end sensing element) a permanent signal representative of the inactive condition of the end sensing element is obtained. In over-stroke operation (the piston moves beyond the operating point of the end sensing element) the end sensing element is transferred to its active condition only for the short period of time during which it is operated by the piston while it performs its over-stroke, because all the rest of the time during which the piston performs its reciprocating movement, the end sensing element remains in its inactive condition. Thus, the active condition of the end sensing element is available only in the form of short-time operating signals the duration of which is determined by the over-stroke length. Even an over-stroke of 100% (!) would raise the signal time to only 50%.

If, therefore, in the case of a conventional two-step action control the end sensing element were connected to the pulse shaper in a manner to ensure that actuation of the end sensing element would interrupt the current pulse emitted by the pulse shaper, the energy content of the current pulses emitted by the pulse shaper would be reduced only very little, in accordance with the short times of operation of the end sensing element by the piston, i.e. in accordance with the duration of the operating signals of the end sensing element.

As a result, the upper dead center position of the compressor piston obtained would lie in the over-stroke area at different, sometimes considerable, distances from the operating point of the end sensing element and, thus, the pre-determined upper dead center position, depending on the particular operating condition.

However, coincidence between the upper dead center position of the compressor piston and the operating point of the end sensing element can be achieved by one particularly preferred embodiment of the invention in which the end sensing element is connected to a control circuit comprising a timing element whose output signal varies in time in the one direction when the signal of the end sensing element is present and in the other direction when the signal of the end sensing element is missing, and wherein the energy content of the current pulses emitted by the pulse shaper can be controlled by the said output signal. The use of a control circuit comprising a timing element offers the advantage that the operating point of the end sensing element and the upper dead center position are practically identical which means that on the one hand the upper dead center position can be observed very exactly and, on the other hand, the wear of the end sensing element, if of a mechanical type, is reduced because it will be subjected only to small deflections just sufficient to make the element respond. The timing element enables the output signal of the control circuit to be timed to ensure that the pre-determined upper dead center position is exactly observed. For example, if the dead center position is not reached, the energy content of the current pulses is regularly increased until the end sensing element responds, whereupon the output signal of the control circuit varies in opposite direction during the operating time of the element. Finally, a state of equilibrium is obtained for a given case of loading.

In a preferred embodiment of the invention, the output signal of the timing element and/or the control circuit varies at a speed much higher in the presence of the signal of the end sensing element than when the signal of the end sensing element is missing. Considering that the period of time during which the end sensing element has been activated, is much shorter than the period of time until the end sensing element will be activated the next time, the variation speeds of the output signal of the timing element and/or the control circuit should conveniently be approximately inversely proportional to the mean periods of time during which the variations take place. To say it in other words, it is desirable that under average operating conditions the output signal should vary in both directions by approximately the same amount during one complete piston stroke.

In a preferred embodiment of the invention, the control circuit has connected to the output of the timing element a converter for generating control pulses for the pulse shaper. The converter may be designed to generate two pulse groups shifted in phase by 180°, in response to a voltage supplied to it, the pulse widths being a function of the applied control voltage. Such a converter may be realized by known integrated circuits, as for instance Messrs. Ferranti's type ZN 1066 E, or Texas Instruments' type SG 1524. Converter of this type are suited particularly well in cases where the oscillating compressor is energized from a DC source, for instance a motor-car battery. In this case, the pulse shaper emits to the oscillating drive of the oscillating compressor pulses of alternating polarity and controlled pulse width. When using an oscillating compressor with an electric oscillating drive which can operate with current pulses of uniform polarity, as for instance an oscillating compressor with electro-magnetic drive in which an iron core is introduced into a stationary winding, the arrangement can be further simplified, because in this case only one pulse group is required and the pulses may (but need not necessarily) be of uniform polarity.

In those embodiments of the invention, in which the oscillating compressor is to be operated with alternating current, for instance from the mains, the converter is designed to emit pulses whose phasing relative to the mains voltage depends on the control voltage supplied by the timing element. This converter is followed by a phase control by means of which the energy content of the current pulses can be varied in a conventional manner. The output pulses of the converter serve preferably to trigger a so-called Triac, which is a component consisting practically of two thyristors in antiparallel connection.

However, the power supply of the oscillating compressor via such a phase control does not allow the supply via a DC source, such as a lead battery, through the same power output stage. However, in many cases it is desirable to have an oscillating compressor that can be energized both from the mains and from a battery, with minimum expense for the current shaper. This means that at least its power output stage must be suited for both, battery operation and mains operation. And this in turn means that in the case of mains operation the current must be rectified and thereafter filtered. As regards the current supply of the control circuits, this does not present any problems, because these components have a relatively low current input. But the means necessary for filtering the working current for the oscillating compressor are quite considerable. In a preferred embodiment of the invention, therefore, a full-wave rectifier is provided on the one hand for feeding the power output stage and, on the other hand, for generating an oscillation of double the mains frequency. This rectifier is followed by a Schmitt trigger which has connected to its output end a differentiating circuit whose output signal serves to synchronize the converter which generates the two pulse groups shifted in phase by 180 degrees for triggering the power stage. This synchronization makes it possible to do without any filter elements for the current applied to the oscillating drive as the width-modulated pulses of the two pulse groups are synchronous to the mains voltage so that the power output stages provided for DC operation can be used.

In a preferred embodiment of the invention, a digital time-lag element is provided between the end sensing element and the timing element. Such a time-lag element makes it possible to displace the upper dead center position without any manipulation at the oscillating compressor. This permits, for instance, adjustments of the upper dead center position to balance out production tolerances. If for instances the time-lag element can be switched on and off, this also offers the possibility to operate the oscillating compressor during the time in which the time-lag element is switched in, in overstroke operation, for instance if the compressor output is to be increased because ice-cubes are needed quickly.

But such a time-lag element may also be used for increasing the duration of the signals emitted by the end sensing element when actuated. So, the signal applied to the time-lag element may for instace be given a time duty factor of approx. 1:1, which means that the signal length is identical to the interval between two signals. The advantage of such an arrangement is to be seen in the fact that to obtain a convenient control action, the timing element need not have two different variation speeds of its output voltage, but that the two variation speeds may be identical. However, in this connection the main emphasis does not lie on the identity of the two variation speeds, but on the fact that the length of the signal emitted by the end sensing element when actuated is increased so that it becomes better controllable, and this simply because a pulse duration of 50% can be adjusted with greater precision than a pulse length of, say 5%.

Depending on the particular circumstances, the digital time-lag element may respond to the leading or to the trailing edge, or to both edges, of the signal of the end-sensing element. The time-lag elements may be retriggerable. They must be re-triggerable if for instance the duration of the signal of the end sensing element is to be extended beyond the duration of one cycle of the oscillating frequency of the oscillating compressor. Thus, the digital time-lag element opens up a great number of possibilities to influence the performace in service of the oscillating compressor, without any need of manipulating the oscillating compressor itself.

Further details and improvements of the invention will become apparent from the claims and the following description of the examples shown in the simplified and schematic drawings, in which:

Figure 2:
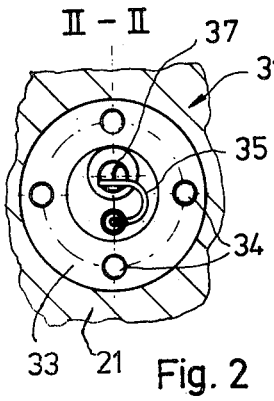
FIG. 2 shows a section along line II—II in FIG. 1.
Figure 1:
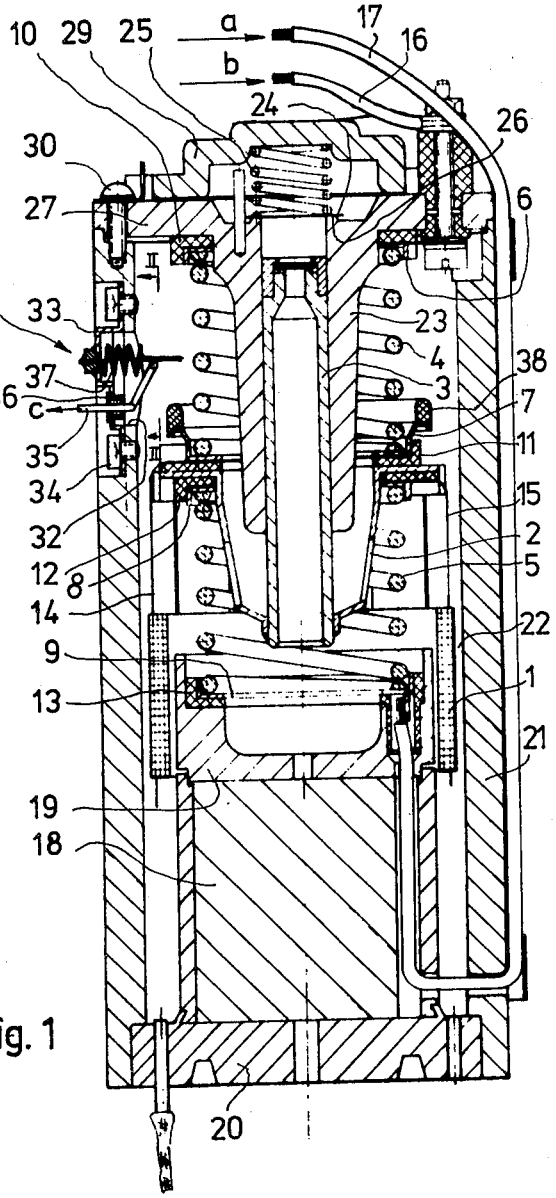
FIG. 1 is a longitudinal cross-section through an oscillating compressor equipped with end-sensing contacts.
Figures 3, 4:
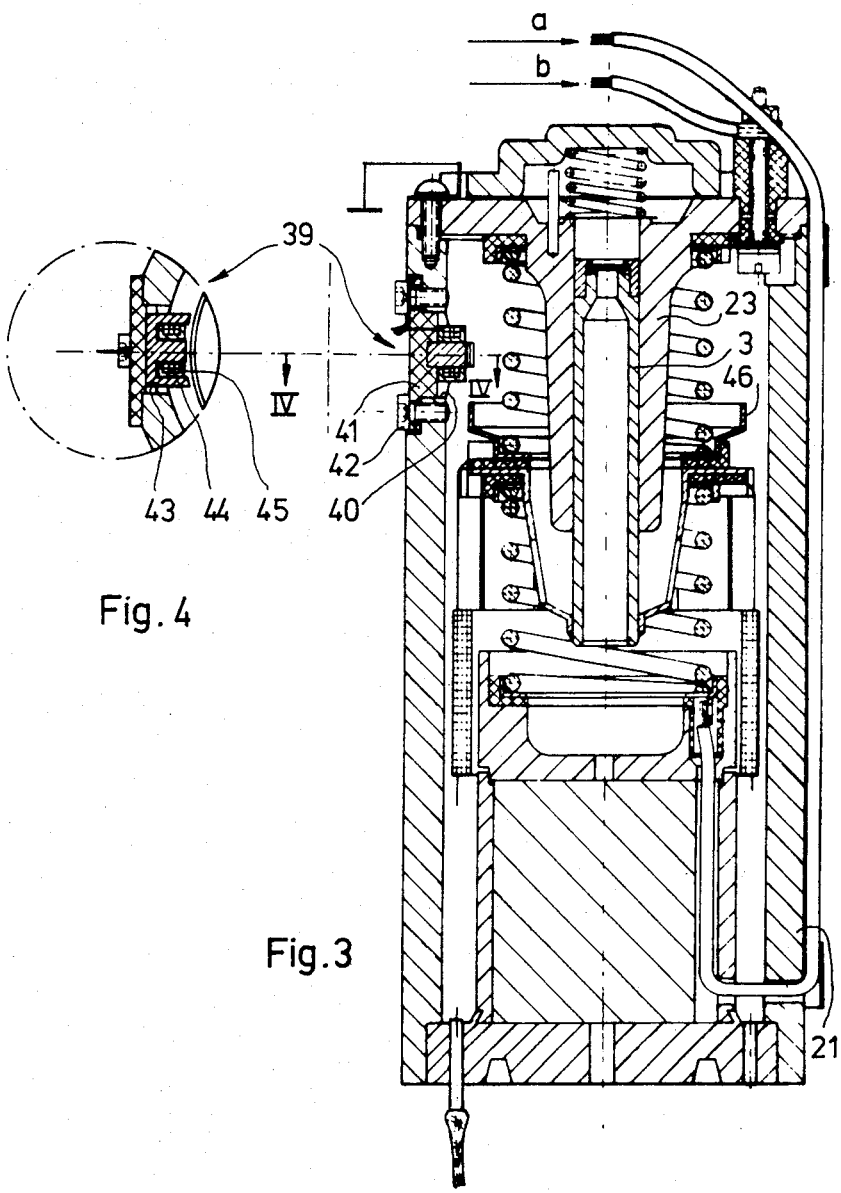
FIG. 3 is a partial view of a longitudinal section through an oscillating compressor with inductive end-sensing element.
FIG. 4 shows a section along line IV—IV in FIG. 3.
Figure 5:
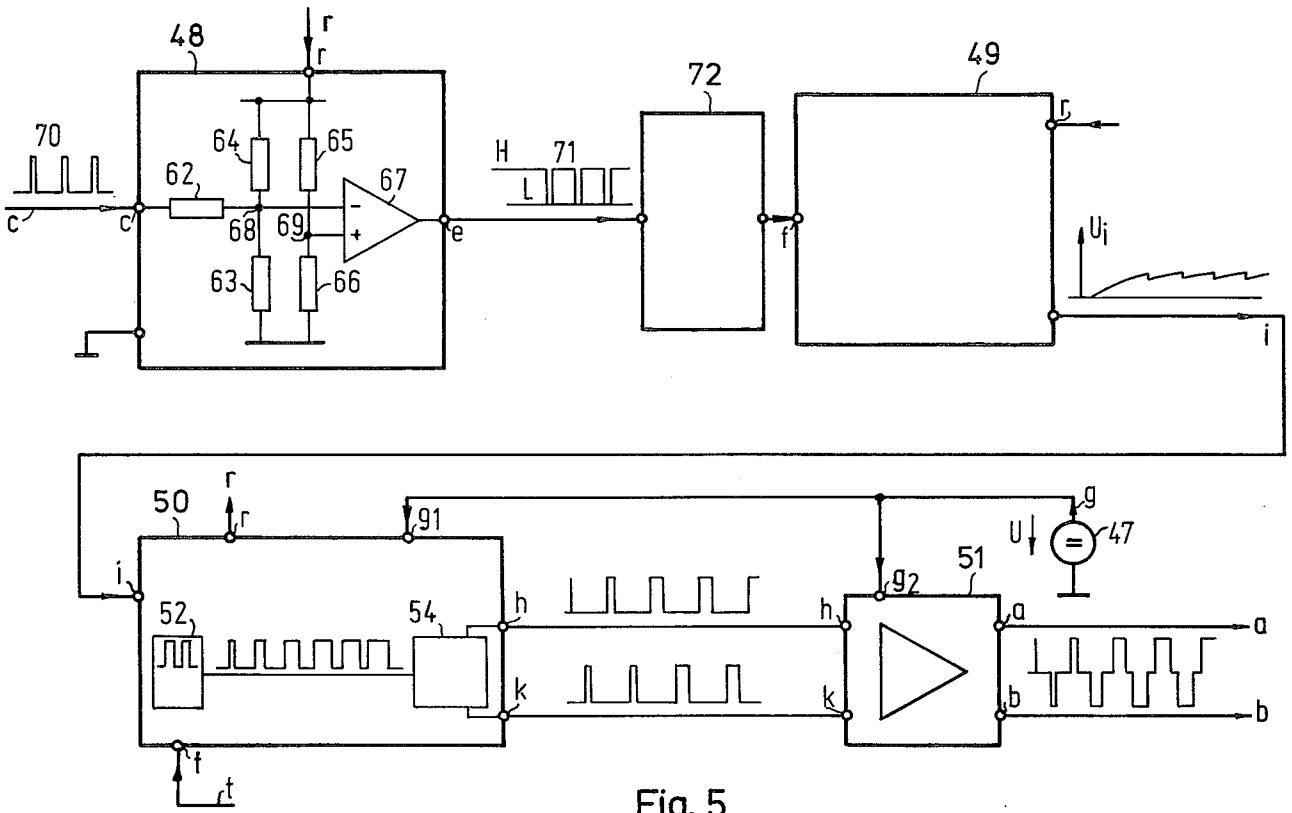
FIG. 5 is a block diagram showing details of the control circuit and the pulse shaper for DC operation.
Figure 7:
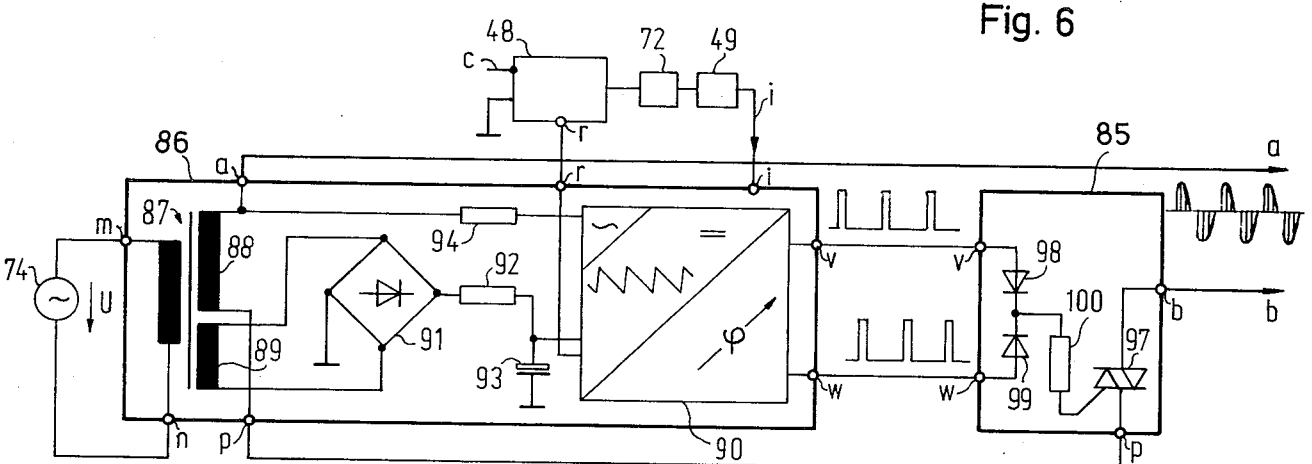
FIG. 7 shows a diagram of the AC supply of an oscillating compressor with phase control.

The longitudinal section of FIGS. 1 and 3 show an oscillating compressor with permanent-dynamic oscillating drive of conventional design (German Patent Specification No. 25 58 667). The oscillating drive comprises an oscillating coil 1 which is held by a coil support 2 and rigidly connected to a compressor piston 3. The assembly comprising the oscillating coil 1, the coil support 2 and the compressor piston 3 is held in a central initial position by biassed oscillating springs 4 and 5. The oscillating springs 4 and 5 simultaneously supply the oscillating coil 1 with the necessary current. Their ends are held in spring plates 6, 7, 8 and 9 which are electricaly insulated against the body of the insulating compressor by means of insulating rings 10, 11, 12 and 13. Supply lines 14 and 15 supply the energizing current to the oscillating coil and are on the other hand electrically connected to the two oscillating springs 4 and 5 respectively. Supply lines 16 and 17 are electrically connected to the fixed ends of the two oscillating springs 4 and 5, respectively. Connections a and b connect the lines 16 and 17 to terminals a and b of the pulse shaper as shown in FIGS. 5 and 7.

A permanent magnet 18 and the soft-iron parts, namely the pole shoe 19, the bottom 20 and the shell 21, form the magnet system with the annular gap 22 between the pole shoe 19 and the shell 21, wherein the oscillation coil 1 is held for displacement without any contact in the direction of the compressor piston 3. A radial DC magnetic field extends through the coil in vertical relation to the local direction of current flow.

The stroke of the compressor piston 3 which is guided in a cylinder 23 is not limited and may extent beyond the pressure side cylinder end. In this case, the piston lifts a valve plate 24 which covers the entire cylinder cross-section and which is pressed by the action of a valve spring 25 against a valve seat 26 forming an integral part of the pressure-side cylinder end. The shell 21 consisting of soft-iron forms also the tubular housing of the oscillating compressor and has its input end closed by a press-fitted bottom 20. The other end of the shell 21 is closed by a flange 27 integrally formed on the cyliner 23. The flange 27 has fastened to its face facing away from the oscillating drive by means of screws not shown in the drawing a pressure chamber 29. The flange 27 itself is fastened by means of screws 30 to the shell 21.

Mounted in the shell 21 of the conventional oscillating compressor described above is an end sensing element 31 taking the form of a normally-closed electric contact. To this end, a radial bore 32 is provided in the shell 21 at about half the height of the cylinder 23. A metal base plate 33 carried the individual components of the end-sensing element 31. It is mounted by means of screws 34 in a recess provided in central relation to the bore 32 in the outer wall of the shell 21. The fixed part and coacting contact takes the form of a wire strap 35 mounted in the base plate 33 and electrically insulated against the latter by means of a glass bushing 36. This coacting contact is externally connected to the terminal c as shown in FIGS. 5 and 7. The movable contact of the end-sensing element 31 takes the form of a helical spring 37 acting as a bending spring loaded vertically to its axial direction and mounted in the base plate 33 by means of an intermediate bushing and a leg bent off in its axial direction. The free end of the helical spring 37 is likewise provided with a leg bent off in its axial direction which is on the one hand biassed against a wire strap 35 so as to connect it electrically to the shell 21, i.e. to ground, and which on the other hand projects beyond the wire strap 35 into the path of movement of an insulating ring 38 mounted at the coil support 2 or the spring plate 7 superimposed upon the said coil support 2. Now, when the compressor piston 3 reaches the pressure-side end of the cylinder 23, the insulating ring 38 gets into contact with the leg of the helical spring 37 and lifts it off the wire strap 35. This interrupts the ground connection of the wire strap 35 and, thus, actuates the end-sensing element 31. The position which the compressor piston 3 occupies at the moment when the end sensing element 31 responds, is the upper dead center postion or pressure-side stationary point of the compressor piston 3. This upper dead center position can be easily adjusted in a very precise manner, or subsequently varied, by slight re-bending of the wire strap 35 serving as coacting contact. It is an additional advantage of this arrangement of the end-sensing element in the wall of the shell 21 that oscillating compressors of conventional design can be subsequently equipped with end-sensing elements of this type. A helical spring 37 acting as a bending spring offers the advantage that maximum deflections can be obtained with minimum space requirements, while preventing at the same time the risk of spring breakage in the course of excessive over-strokes which may possibly be encountered in case of troubles or improper operation. The fact that the actuating element of the end-sensing element 31 takes the form of the insulating ring 38 makes it possible for the compressor piston 3 to rotate about its longitudinal axis without affecting the operation.

Except for the end-sensing element, the oscillating compressor shown in FIG. 3 has the same constructional design as the one shown in FIG. 1. But contrary to the latter it is provided with an inductive end-sensing element 39 mounted within the shell 21 in the same manner as the end-sensing element 31. To this end, the shell 21 is provided with a radial bore 40 with base plate 41 consisting of an electrically non-conductive material fastened by means of two screws 42 within a recess provided in centrical relation to the bore 40. The inductance is provided in the form of an open E core 43 of a high-resistance soft-magnetic material such as known for instance as ferrite. The central leg carries a winding 44 with a coil base 45. In order to improve the effect of an operating ring 46 which is either formed as an integral part of or mounted to the spring plate 7, the open ends of the legs of the E core 43 are arranged along an arc of a circle extending concentrically to the axis of the compressor piston 3. Preferably, the operating ring 46 is formed by an upwardly extending collar of the spring plate 7 drawn from sheet steel. The outer diameter of the operating ring 46 is slightly smaller than the diameter of the cylinder face sections of the end faces of the legs of the E core 43. Shortly before the compressor piston 3 reaches the desired upper dead center position, the operating ring 46 comes within the area of the legs of the E core 43 causing the inductance of the winding 44 to rise. As the operating ring 46 moves further on, the inductance continues to rise. The pre-determined inductance determining the upper dead center position is reached when the free upper edge of the operating ring 46 has reached approximately the height of the center line of the legs of the E core 43, i.e. when it overlaps approximately one half of the legs of the E core. The two ends of the winding 44 project outwardly through the base plate 41. One winding end is electrically grounded by means of a fastening screw 42, while the other winding end is connected to a circuit group which emits a signal at the moment when the pre-determined inductance is reached.

Figure 6:
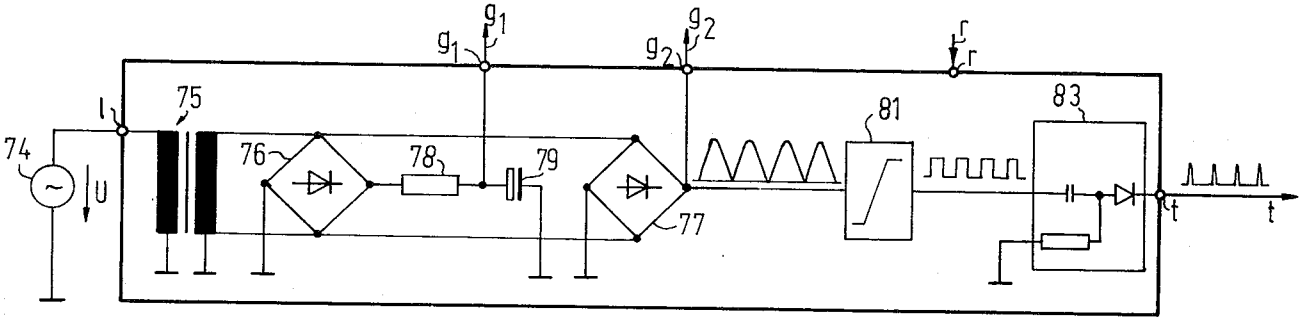
FIG. 6 is a schematic diagram showing the supply of the oscillating compressor and the control circuit of FIG. 5 with AC current.

FIGS. 5 to 7 show examples of the external circuit arrangement, represented partly in the form of a block diagram and partly in the form of simplified circuit diagrams. The electric connections of the individual blocks and circuit groups are denoted by small letters. Connections marked with the same letter are interconnected, even though this may not always be fully shown in the drawing. The circuit arrangement shown in FIG. 5 makes it possible to operate the oscillating compressor of FIG. 1 with the end-sensing element 31 from a DC source 47. In this case, the circuit arrangement comprises four main components, namely one signal converter 48, one timing element 49, one converter 50 and one power output stage 51.

The signal converter 48 is supplied from the converter 50 via connection r with a reference voltage generated by the converter 50 as constant voltage. The input c is connected to the end-sensing element 31. A high-ohmic resistor combination 62, 63, 64 ensures that the end-sensing element 31 will be supplied only with currents in the microampere range. A divider point 69 of a voltage divider comprising resistors 65 and 66 is connected to the non-inverted input of an operational amplifier 67; one divider point 68 of the voltage divider 64, 63, is connected directly to the inverted input of the operational amplifier 67 and via a resistor 62 to the input c. The operational amplifier 67 acts as a comparator without inverse feed-back to determine whether the voltage encountered at the divider point 68 is higher or lower than the voltage encountered at the divider point 69. Accordingly, either a H level or a L level is applied to the operational amplifier 67 and to the output e of the signal converter 48 connected therewith. The resistors 62, 63, 64 are sized to ensure that when the input c is open, i.e. when the normally-closed contact has been actuated and/or the end-sensing element 31 has been operated, the L level appears at the output 4, while the H level appears at the output e when the connection c is connected to ground, i.e. when the end-sensing element 31 is in its inoperative position.

A time-lag element 72 of the type described before (which may however also be omitted) is connected between the output e of the signal converter 48 and an input f of the time-lag element 49. The simplest and cheapest way to realize the timing element 49 is a RC circuit which has given good test results. The timing element 49 is again supplied with a reference voltage through connection r. The voltage obtained at the output i of the timing element 49 rises in accordance with an e curve when a H level is present at the input f and drops in accordance with an e curve when a L level is applied to the input f. If different rising and dropping speeds are desired for the voltage at the output i, this can be achieved by separate charging and discharging resistors of the RC circuit, with correspondingly polarized diodes connected in series to the said resistors, so that only one of the two resistors will be operative at any time. It is also possible to use linear circuit arrangements for the timing element. Normally, the circuit arrangement will be designed to ensure that the drop of the output voltage occurs at a speed higher than the rise because the H level is normally present during longer periods of time as compared to the L level.

The output i of the timing element 49 is connected to the input i of the converter 50. The converter 40 may consist of integrated circuits such as Messrs. Ferranti's type ZN 1066 E or the Texas Instruments' type SG 1524. The converter 50 is supplied from the DC source 47 via a connection g1. It generates the reference voltage for the signal converter 48 and the timing element 49 (and for the time-lag element 72, if any). The converter 50 comprises an oscillator 52 supplying pulses of a polarity and frequency equalling twice the frequency of the supply voltage for the oscillating compressor. The pulse width of the output pulses is a function of the voltage at the input i. The pulse width may be varied between 0 to approx. 99% of the total duration of pulse plus interval (pulse width modulation). A logical circuit 54 distributes the pulses of the oscillator 52 alternately to the output h and k so that the latter are supplied with pulse sequences of the frequency of the oscillating compressor, the individual pulses of the pulse sequences being shifted in phase against each other by half the duration of a cycle. The oscillator 52 comprises further a connection t for synchronization with an external frequency which must be applied in the form of a sequence of needle pulses.

The power output stage 51 takes usually the form of an ironless output stages and comprises in a conventional manner four power transistors in bridge connection used as switching transistors, one branch being connected to the DC source 47 via a connection g2, and the other branch leading to the output a and b which are in turn connected to the connections a and b of the oscillating compressor. The pulse sequences applied to the inputs h and k alternately connect through two oppositely arranged bridge transistors, in accordance with the duration of their pulses, so that the input a, b, of the oscillating compressor is supplied with a rectangular alternating voltage whose pulse width depends on th value of the voltage present at the connection i of the converter 50.

The end-sensing element 31 which is shortly actuated by the oscillating compressor 3 when it reaches the pre-determined upper dead center position triggers at the input c of the signal converter 48 a pulse which is inverted in the signal converter 48. Accordingly, the sequence of piston strokes creates at the output e a pulse sequence consisting of relatively long H levels separated by short L levels. The time-lag element 72 makes it for instance possible to increase the pulse width of the L level.

Every time when the oscillating compressor is started, for instance when the refrigerator thermometer responds, the following takes place:

As soon as the voltage source 47 is connected to the converter 50 and the power stage 51, the signal converter 48 and the timing element 49 are supplied with their reference voltage. The output voltage at the output i of the timing element 49 rises from 0 along an e curve. At the input i of the converter 50, this rising voltage results in an increase of the pulse width at the output of the oscillator 52 and, thus, also at the outputs h and k of the converter 50. Likewise, the pulse width of the output pulses at the outputs a and b of the power output stage 51 rises correspondingly, thus increasing the energy content of the pulses. This causes the amplitude of the oscillating coil 1, which is supplied with these current pulses, and of the piston 3 connected therewith to rise, starting from 0. This rising phase continues until the stroke of the compressor piston 3 has reached a length sufficient to bring the piston up to the pre-determined upper dead center position, thereby shortly opening the end-sensing element 31. As a result of the opening of the end-sensing element, there appears at the input c a voltage pulse of a duration equal to the time during which the end-sensing element 31 was open. The same but inverted pulse appears also at the output e of the signal converter 48 and is instantaneously supplied to the input f of the timing element 49. While the L level is present at the input f, the voltage at the output i drops along an e curve, but this drop occurs at a speed higher than that of the rise encountered while the H level is present at the input f. The voltage drop at the output i of the timing element 49 and, thus, also at the input i of the converter 50 results in a reduction of the pulse width of the pulses at the outputs h and k of the converter 50 and, accordingly, also of the width of the pulses at the outputs a and b of the power output stage 51. And this in turn results in a further decrease of the amplitude of the oscillating coil 1 and, thus, the compressor piston 3. During the downward phase which of course is restricted to the short time of the open condition of the end-sensing element 31 and, thus, the resulting presence of the L level at the input f of the timing element 49, the voltage at the output i of the timing element 49 must drop sufficiently to balance out its rise during the long rising phase between two L level pulses. Accordingly, the course in time of the voltage at the output i of the timing element 49 comprises flat rises of relative long duration alternating with steep drops of short duration.

The higher the dropping speeds as compared to the rising speeds, the shorter are the L pulses that are needed at the input f of the timing element 49. Shorter L pulses mean shorter actuated times of the end-sensing element 31. And this in turn means that the over-stroke of the compressor piston 3 beyond the response threshold of the end-sensing element 31 can be kept within negligible limits. If for instance the piston stroke between the upper and the lower dead center position is 20 mm at an oscillating frequency of 50 Hz, the oscillation period is 20 ms. We will assume that the timing element 49 has been selected to ensure that it takes 1.5 to 2 s until the oscillating compressor, after having been started, reaches the pre-determined upper dead center position for the first time. Now, if the dropping speed for the voltage at the output i of the timing element 49 is selected to be approx. 20 times the rising speed, a pulse duration of 1/20 of the oscillation period, i.e. a duration of 1 ms for the L level pulse, will suffice to balance out the rise occurring in the intervals between two L levels at the input f of the timing element 49. To render the end limit switch 31 operative for 1 ms, the compressor stroke 3 performs an over-stroke beyond the response threshold of the end-sensing element 31 of 0.12 mm. This means that the desired upper dead center position is observed with an accuracy far below 1% of the piston stroke of 20 mm. Grace to this extreme accuracy it has become possible for the first time to equip oscillating compressors, just as motor compressors, also with a fixed pressure-side bottom plate, instead of the spring-loaded pressure valve plate covering the whole clear cylinder cross-section required heretofore. This is a considerable progress over the prior art which constitutes a particular advantage in oscillating compressors of higher capacities, because the difficulties connected with the design of a functional and safe liftable and spring-loaded pressure valve plate rise out of proportion as the cylinder cross-sections increase and get completely out of control when a certain cylinder cross-section is exceeded.

In the example described above, the duration of the L level at the input f of the timing element 49 is approx. 1 ms and the duration of the H level is approx. 19 ms. Assuming now that the time-lag element 72 is connected between the output e of the signal converter 48 and the input 5 of the timing element 49, that it is set to a time-lag of 9 ms and that it is further designed to be triggered by the transition from L level to H level, then the L and H level are applied to the input f of the timing element 49 for the same period of time. This permits making the rising speed and the dropping speed of the voltage at the output i of the timing element 49 approximately equal which offers the advantage to simplify the selection of the dropping speed because small variations do not have so significant effects.

Modern, portable small refrigerators can generally be operated at choice from the AC mains or from the motor-car battery. Often, the change-over is effected automatically, which means that in the case of mains operation the motor-car battery is simultaneously charged, while the motor-car battery takes over when no mains current is available. To this end, a power transformer is required which with the aid of a rectifier and corresponding smoothing means constitutes a power source equivalent to the DC source 47. Although the battery forms a good buffer, the smoothing means cannot be dispensed with. Moreover, the refrigerator must be operative also when no battery is available or when the unit is intended for AC operation only. However, the expense of the necessary smoothing means is considerable. The circuit arrangement shown in FIG. 6, which supplements the circuit arrangement shown in FIG. 5 for AC operation, makes it possible to do without the expensive smoothing capacitors.

A power transformer 75 supplied from an AC source 74 (AC mains) via a connection 1 feeds two full-wave rectifiers 76 and 77 via its secondary winding. The rectifier 76 supplies to the connection g1 of the converter 50 via a resistor 78 a DC voltage effectively pre-smoothed by a capacitor 79. Considering that the current absorption of the converter 50 is only low, a relatively small capacitor will suffice to ensure sufficient smoothing. The rectifier 77 is a power rectifier serving to transmit the electric power for the oscillating compressor. The rectified full-wave current supplied by it is directly supplied to the connection g2 of the power output stage 51. In addition, the output of the rectifier 77 is connected to a Schmitt trigger 81. At the output of this Schmitt trigger 81, a sequence of rectangular pulses with a pulse duty factor of approx. 50% is generated. A pulse shaper circuit 83 (differentiating circuit) generates from the rectangular pulses needle pulses of alternating polarity. The pulses of the one polarity are clipped by a diode. The needle pulses are supplied from the output t of the pulse shaper 83 to the synchronizing input t of the converter 50 and the oscillator 52 which accordingly is synchronized with the alternating current at the secondary side of the power transformer 75. The Schmitt trigger 81 and the pulse shaper 83 receive their reference voltage from the output r of the converter 50. The condition that the triggering frequency for the oscillator 52 must be double the frequency of the oscillating compressor is met by the fact that the half-wave frequency at the output of the rectifier 77 is equal to double the mains frequency.

The sine half-wave of the rectifier 77 supplied via connection g2 of the power output stage 50 are always synchronous to rectangular pulses supplied via inputs h and k of the power output stage 51. According to the pulse width of these rectangular pulses, sine half-wave ranges of greater or smaller width are connected through to the outputs a and b of the power output stage 51. As the sine half-waves are available always in correct phase for the pulse sequences modulated in pulse width, for through-connection of the power output stage 51, no smoothing means are needed for the DC voltage of the power rectifier 77.

However, the oscillating compressor of the invention may also be phase-controlled in the case of AC operation. This is effected by means of the circuit shown in FIG. 7. This circuit comprises a power stage 85 and a control stage 86. The control stage 86 comprises a transformer 87 with a power and a control winding 88 and an auxiliary winding 89. In addition, the control stage 86 comprises a voltage/phase converter 90 which may for instance take the form of an integrated circuit for triggering Triacs, such as Siemens' type TCA 780. The power transformer 87 is fed by the AC source 74 via connections m and n. The secondary auxiliary winding 89 supplies through a bridge rectifier 91 a supply voltage for the converter 90 which has been well smoothed by means of a resistor 92 and a capacitor 93. The converter 90 generates an internal reference voltage which is applied to the signal converter 48 and the timing element 49 through the connections r. The secondary power winding 88 is connected to ground at one terminal via connection p. On the other hand, it is directly connected to the connection a of the oscillating compressor, via connection a. Also connected to the same connection of the power winding 88, via a high-ohmic resistor 94 is one input of the converter 90 which serves as synchronizing input for pulses generated at the outputs v and w. The phase position of the pulses at the outputs v and w depends on a voltage which is applied to the input i of the converter 90 and which is the output voltage obtained at the output i of the timing element 49. The outputs v and w are connected to inputs v and w of the power stage 85, and the latter in turn are connected to the anodes of diodes 98 and 99 which have their cathodes connected with each other and, via a resistor 100, also to the gate connection of a Triac 97. The pulses which have been synchronized with the voltage at the power winding through the resistor 94 are shifted in phase corresponding to the voltage at the input i of the converter 90. Moreover, the pulses at the connection v are shifted in phase by 180 degrees relative to the pulses at the output w. They fire the Triac 97 via the resistor 100, and as a result thereof rectified sine half-waves with alternating polarity and an area that depends on the control voltage at connection i supplied by the timing element 49, are obtained at the output b of the power stage 85.

What we claim is:

1. An electrically driven oscillating compressor, in particular for use as a refrigerating machine, comprising:

a piston compressor having a compressor piston which is resiliently in a central initial position, a cylinder, said compressor piston having an upper dead center position, said cylinder having a pressure side cylinder end, an electric oscillating drive for directly driving the piston compressor, said oscillating drive having electric components, a pulse shaper for supplying current pulses to the electric oscillating drive, said current pulses having an energy content, a signal converter, a control circuit, other oscillating masses, wherein the group consisting of the compressor piston, the other oscillating masses, and the electric components of the oscillating drive form an electro-mechanical oscillating system whose natural frequency is at least approximately equal to the frequency of the current pulses energizing the oscillating drive, characterized in that the upper dead center position of the compressor piston can be set to a predetermined value in the area of the pressure side cylinder end by controlling the energy content of the current pulses supplied by the pulse shaper, and an end-sensing element, which in connection with said signal converter, emits an electrical signal as soon as the compressor piston reaches or passes the predetermined upper dead center position, wherein the end-sensing element is connected to said control circuit, said control circuit comprising a timing element whose output signal varies in time in the one direction when said electrical signal of the end-sensing element is present and in the other direction when said electrical signal of the end-sensing element is missing, and wherein the energy content of the current pulses emitted by the pulse shaper can be controlled by said output signal.

2. An oscillating compressor in accordance with claim 1, characterized in that the output signal of the timing element or the control circuit, respectively, varies at a speed much higher in the presence of the signal of the end-sensing element than when the signal of the end-sensing element is missing.

3. An oscillating compressor in accordance with claim 1, characterized in that the control circuit has connected to the output of the timing element a converter for generating control pulses for the pulse shaper.

4. An oscillating compressor in accordance with claim 3, characterized in that the converter is designed to generate two pulse groups shifted in phase by 180°, in response to a voltage supplied to it, the pulse widths being a function of the supplied voltage.

5. An oscillating compressor for mains operation in accordance with claim 3, characterized in that the converter is designed to emit pulses whose phasing relative to the mains voltage depends on the voltage supplied by the timing element.

6. An oscillating compressor for mains operation in accordance with claim 3, characterized in that a full-wave rectifier is provided on the one hand for feeding the power output stage and, on the other hand, for generating an oscillation of double the mains frequency and that this rectifier is followed by a Schmitt trigger which has, connected to its output terminal, a differentiating circuit whose output signal serves to synchronize the converter which in turn controls the power stage.

7. An oscillating compressor in accordance with claim 2, characterized in that a digital time-lag element is connected between the end-sensing element and the timing element.

* * * * *